US005505107A

United States Patent [19]

Frost

[11] Patent Number: 5,505,107

[45] Date of Patent: Apr. 9, 1996

[54] METHOD AND APPARATUS FOR SHARPENING CUTTING BLADES

[75] Inventor: Joseph E. Frost, Sioux City, Iowa

[73] Assignee: IBP, Inc., Dakota Dunes, S. Dak.

[21] Appl. No.: 209,209

[22] Filed: Mar. 4, 1994

[51] Int. Cl.[6] ..... B24B 3/54

[52] U.S. Cl. ..... 76/86; 76/82

[58] Field of Search ..... 76/82, 85, 86

[56] References Cited

U.S. PATENT DOCUMENTS

| | | | |
|---|---|---|---|
| 1,041,631 | 10/1912 | Johnson et al. | 76/86 |
| 1,570,083 | 1/1926 | Runzi . | |
| 1,909,743 | 5/1933 | Blankner . | |
| 2,124,646 | 7/1938 | Barsch . | |
| 2,951,400 | 9/1960 | Renne, Jr. et al. | 76/86 |
| 3,755,970 | 9/1973 | Parr | 76/82 |
| 4,102,085 | 7/1978 | Church et al. . | |
| 4,550,632 | 11/1985 | Inman | 76/86 |
| 4,934,110 | 6/1990 | Juranitch . | |

FOREIGN PATENT DOCUMENTS

| | | | |
|---|---|---|---|
| 497317 | 9/1954 | Italy | 76/86 |
| 293785 | 3/1928 | United Kingdom . | |
| 517242 | 1/1940 | United Kingdom . | |

*Primary Examiner*—Hwei-Siu Payer

*Attorney, Agent, or Firm*—Beveridge, DeGrandi, Weilacher & Young

[57] ABSTRACT

A sharpener has two sharpening members pivotally mounted on opposite sides of a reference plane. Each sharpening member includes a counterweight portion below its pivot and a sharpening portion above its pivot. The sharpening portions have convex sharpening edges which overlap laterally to form a vertically movable V-shaped slot for receiving a cutting blade. A cutting blade is placed in the slot and moved lengthwise and downwardly. The downward movement causes the vertex of the V-shaped slot to move down, but the slot's vertex angle remains substantially constant because the curvatures of the sharpening edges increase progressively from upper regions to lower regions of the sharpening edges. The centers of gravity of the sharpening members are laterally inboard of the pivots, and the sharpening edges are higher than the pivots. The sharpening forces exerted by the sharpening edges against a cutting blade increase in response to downward movement of the slot vertex. An abutment is mounted on each pivot to stop the clockwise and counterclockwise rotation of the opposed sharpening member.

23 Claims, 1 Drawing Sheet

METHOD AND APPARATUS FOR SHARPENING CUTTING BLADES

BACKGROUND OF THE INVENTION

This invention relates to an apparatus and method for restoring sharpness and improving the geometric shape of knives and other cutting blades. The invention may be used with many types of cutting blades but it is particularly effective with knife edges of straight, curved, circular, or cylindrical shapes with single bevel, double bevel, or modified chiseled bevel geometry.

Ideally, the edge of a cutting blade should have adjacent faces which, in cross-section, converge at a constant slope to a single point which is the ideal cutting edge vertex. In practice, however, this is rarely achieved. The slopes vary, and there is no single point of convergence. In the course of normal use of a cutting blade, the material at the edge is displaced away from the ideal vertex, changing the slopes of the faces at the edge and providing an arcuate profile at the edge. This reduces the efficiency of the cutting blade, it requires more cutting force, and it produces irregular shearing of the material being cut.

A number of devices have been proposed to restore and improve the edges of cutting blades. Some remove material by grinding or honing. Grinding creates the desired geometric shape. Honing improves the surface finish and the sharpness of the edge. These methods have minimal effect on the microstructure of the arcuate profile at the edge.

Rather than removing material, it is possible to sharpen a cutting edge by burnishing it. By using such a technique, the material is deformed to blend the curvature of the arcuate profile with the faces of the cutting blade. The present invention uses such a technique in a manner which is believed to produce results superior to those of prior burnishing devices.

SUMMARY OF THE INVENTION

According to the present invention, a sharpener for sharpening a cutting blade includes a left sharpening member pivotally supported on a left pivot which is spaced to the left of a reference plane, and a right sharpening member pivotally supported on a right pivot which is spaced to the right of the reference plane. The left sharpening member has a left sharpening portion located above the left pivot and a left counterweight portion located below the left pivot. The left sharpening member has a center of gravity positioned to provide clockwise pivotal movement of the left sharpening member. The left sharpening portion has a left sharpening edge which faces rightward and intersects the reference plane to contact and sharpen a cutting blade located in the reference plane. Similarly, the right sharpening member has a right sharpening portion located above the right pivot and a right counterweight portion located below the right pivot. The center of gravity of the right sharpening member is positioned to provide counterclockwise pivotal movement of the right sharpening member. The right sharpening portion has a right sharpening edge which faces leftward and intersects the reference plane to contact and sharpen a cutting blade located in the reference plane.

Preferably, the sharpener has a blade guide with a guide surface located substantially in the reference plane. The sharpening members are made of zirconia or alumina, and each of the sharpening edges has a curvature which increases progressively from upper regions of the sharpening edge to lower regions of the sharpening edge. The curvatures of the sharpening edges is such that, throughout their range of movement, they intersect the reference plane at a substantially constant angle. Stop means are provided for limiting the clockwise and counterclockwise movements of the sharpening members. A left pivot member which supports the left sharpening member also supports an abutment member for limiting the rotational movement of the right sharpening member; and, a right pivot member which supports the right sharpening member also supports an abutment member for limiting the rotational movement of the left sharpening member.

In another respect the invention involves a sharpener for sharpening a cutting blade which has two converging surfaces, the geometric extensions of which in cross-section intersect at an ideal cutting edge vertex. Such a sharpener includes two pivoted sharpening members with sharpening edges which form opposite sides of a V-shaped slot for receiving a cutting blade which has a cutting edge. The V-shaped slot has a slot vertex. The sharpening members are supported for movement about fixed pivots in directions which result in downward movement of the slot vertex. The sharpener has force producing means for producing forces which urge the sharpening members toward each other to exert forces on the cutting blade which increase in response to downward movement of the slot vertex.

In still another respect, the invention relates to a knife sharpener in which the sharpening members are movable to positions where they contact the cutting blade at different distances from the ideal cutting edge vertex. Force producing means produces forces on the cutting blade which are smaller when the sharpening edges contact the cutting blade nearer the cutting edge vertex than when the sharpening edges contact the ideal cutting blade farther from the cutting edge vertex.

The inventions as described in the two preceding paragraphs preferably include some additional features. For example, the sharpening members are made of alumina or zirconia, their sharpening edges have convex curvatures which face the slot, and these curvatures increases progressively from upper regions of the sharpening edges to lower regions of the sharpening edges. Throughout their range of movement, the sharpening edges intersect the reference plane at a substantially constant angle. Each sharpening member includes a sharpening portion located above its respective pivot, and a counterweight portion location below its respective pivot. Stop means are mounted on each pivot to limit the pivotal movement of the other sharpening member.

The invention also involves a sharpener in which the V-shaped slot has a slot vertex located in a reference plane. The sharpening members are supported on fixed pivots which are lower than the sharpening edges. Each of the sharpening members has a center of gravity which is lower than its sharpening edge and is closer than its pivot to the reference plane so the sharpening members are gravitationally rotated in directions which urge their sharpening edges toward the reference plane. Thus, gravitationally produced forces exerted by the sharpening edges on the blade increase in response to downward movement of the cutting blade and slot vertex. Preferably, the sharpening members are formed of zirconia or alumina, and each of the sharpening edges has a convex curvature which faces the slot. The convex curvatures increase progressively from upper regions of the sharpening edge to lower regions of the sharpening edge. Throughout their range of movement, the sharpening edges intersect the reference plane at substantially constant angles.

Stop means are provided for limiting the pivotal movement of the sharpening members. The sharpener has a frame; pivots on the frame support the sharpening members; and, an abutment is mounted on each pivot to limit the pivotal movement of the other sharpening member.

Additionally, the invention involves a method of sharpening a cutting blade which has two converging surfaces, the geometric extensions of which in cross-section intersect at an ideal cutting edge vertex. The method is performed with two pivoted sharpening members with sharpening edges which form opposite sides of a V-shaped slot for receiving a cutting blade which has a cutting edge. The V-shaped slot has a slot vertex located in a reference plane. The method includes the steps of supporting the sharpening members for movement about fixed pivots which are lower than the sharpening edges. Each of the sharpening members has a center of gravity which is lower than its sharpening edge and is closer than its pivot to the reference plane. The sharpening members are gravitationally rotated in directions which urge their sharpening edges above the slot vertex toward the reference plane. The cutting edge of a cutting blade in held and moved in the slot vertex at a position where the slot vertex is higher than the pivots so that gravitationally produced forces exerted by the sharpening edges on the blade increase in response to downward movement of the cutting blade and slot vertex. Preferably, the cutting blade and slot vertex are moved downwardly while the sharpening edges at the slot vertex are maintained at substantially constant angles to the reference plane. The movement of the sharpening members is limited to stop the downward movement of the blade and slot vertex.

DETAILED DESCRIPTION

Figure 1:
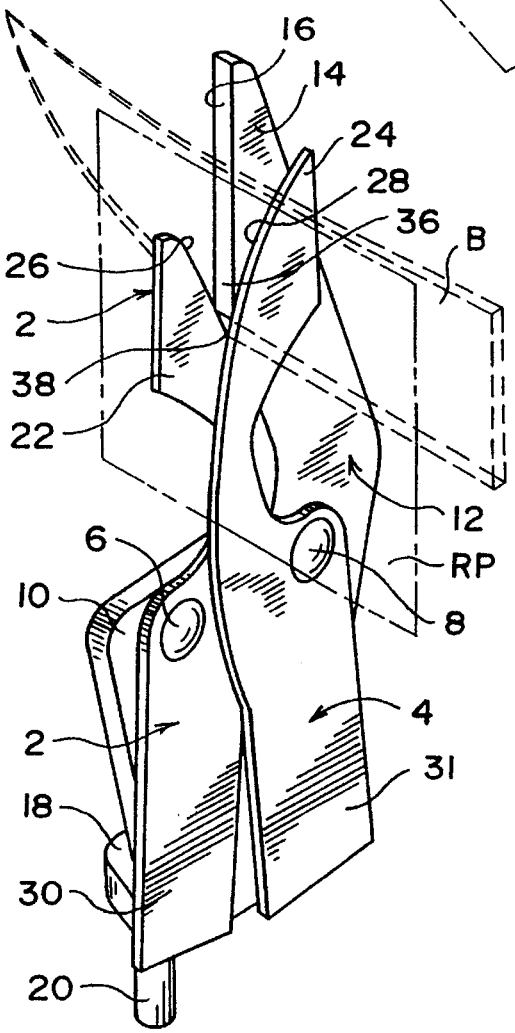
FIG. 1 is a perspective view of a preferred sharpener constructed according to the invention.

As shown in FIG. 1, two sharpening members 2 and 4 are supported by pivots 6 and 8 which are fixed on a vertical flange 10 of a base or bracket member 12. The vertical flange 10 has an upper portion 14 provided with a guide surface 16 which assists in positioning a knife or other cutting blade.

The bracket 12 has a horizontal mounting flange 18 provided with a tapered mounting pin 20 which can be frictionally retained in a mounting hole drilled at the work station. Rather than being mounted on a flat horizontal surface as shown, the device may be mounted on a horizontal bar or be attached to a handle. The bracket 12 is preferably made of a plastic material such as Lexan which is sufficiently durable for use in an industrial setting, and is soft in the respect that it will not have an undue dulling effect on any knife blade that contacts it. The pivot pins 6 and 8 for the members 2 and 4 are frictionally retained by interference fits in holes in the flange 10, and their protruding ends can be upset to retain them in position.

Figure 3:
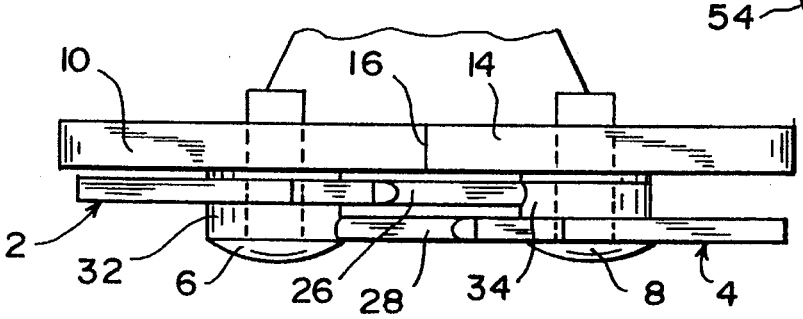
FIG. 3 is a plan view of the device.

The left and right sharpening members 2 and 4 are mirror images of each other, and they lie on opposite sides of a central reference plane RP which is substantially coincident with the guide surface 16. As shown in FIG. 3, the sharpening members are in adjacent parallel planes so they pass alongside each other. Within their ranges of movement, the sharpening members are freely movable about their pivots.

Each of the sharpening members 2 and 4 has a sharpening portion 22, 24 with a sharpening edge 26, 28 located above the respective pivot, and a counterweight portion 30, 31 located below the pivot. The sharpening edges are semicircular in horizontal cross-section. The inward and outward travel of the sharpening portions 22 and 24 is limited by annular spacers 32 and 34 which serve as abutments and preferably are mounted on the pivots. Thus, the pivot 6 and spacer 32 limit the counterclockwise movement of the right sharpening member 4. Similarly, the pivot 8 and the spacer 34 limit the clockwise movement of the left sharpening member 2.

Figure 2:
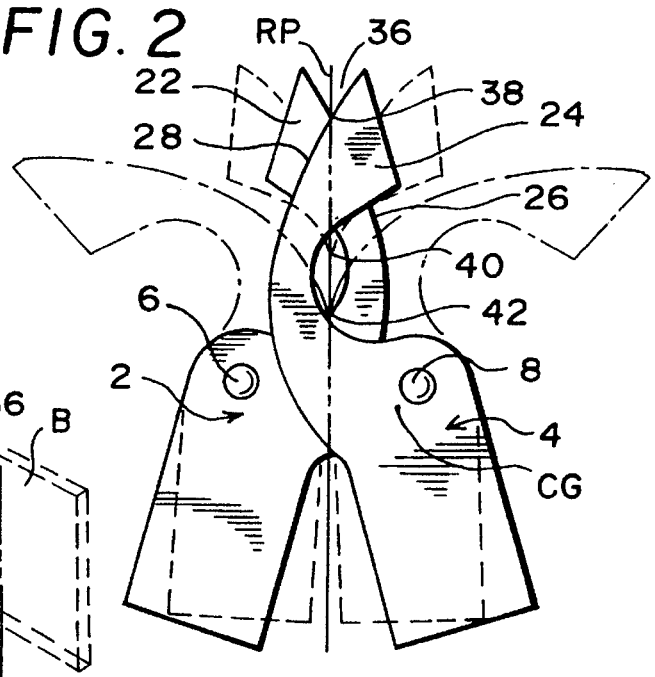
FIG. 2 is a front view of the sharpening members of the device, showing the relationship between their sharpening edges when they are in various pivoted positions.

As shown in FIG. 2, looking in the longitudinal or axial direction, the sharpening members 2 and 4 form opposite sides of a V-shaped slot 36 which receives the cutting blade. The reference plane RP bisects slot 36. The initial or rest position of the vertex of this slot is shown at 38. When a cutting blade is placed in the slot 36, the sharpening portions 22 and 24 of the members 2 and 4 move laterally outwardly in opposite directions, and the slot vertex moves down. The rest positions of the sharpening members 2 and 4 are shown in solid lines, their intermediate positions are shown in broken lines, and their lowest positions are shown in dot-dash lines. An intermediate position of the slot vertex is designated 40, and its lowest position is shown at 42.

Each of the sharpening edges 26 and 28 has a curvature which increases progressively from upper regions to lower regions of the sharpening edge. These curvatures are such that, throughout the range of movement of the sharpening members, the sharpening edges intersect the reference plane at a substantially constant angle so that the difference between the minimum and maximum angles is no more than about ten degrees. The geometrical coordinates of the curve of the sharpening members is put in the following 19×2 matrix:

| | | | |
|---|---|---|---|
| | | 0 | 0.93 |
| | | 0.125 | 0.98 |
| | | 0.25 | 1.02 |
| | | 0.37 | 1.05 |
| | | 0.5 | 1.06 |
| | | 0.62 | 1.05 |
| | | 0.75 | 1.04 |
| | | 0.87 | 1.01 |
| 1: | | 1.0 | 0.98 |
| | | 1.12 | 0.92 |
| | | 1.25 | 0.87 |
| | | 1.37 | 0.79 |
| | | 1.5 | 0.71 |
| | | 1.67 | 0.62 |
| | | 1.75 | 0.51 |
| | | 1.87 | 0.4 |
| | | 2.0 | 0.27 |
| | | 2.12 | 0.14 |
| | | 2.25 | 0 |
| 2: | V: | $AX^{18} + BX^{17} + CX^{16} + DX^{15} + EX^{14} + FX^{13} + GX^{12} + HX^{11} + IX^{10} + JX^{9} + KX^{8} + LX^{7} + MX^{6} + NX^{5} + OX^{4} + PX^{3} + QX^{2} + RX + S$ | |

The mathematical expression describing the curve of the sharpening member is as follows:

$$-2.42143\ 10^{-6}\ X^{18} + 1.33797\ 10^{-6}\ X^{17} + 1.17152\ 10^{-4}\ X^{16}$$
$$-4.79525\ 10^{-4}\ X^{15} + 5.17698\ 10^{-4}\ X^{14} - 2.81313\ 10^{-4}\ X^{13}$$

-continued $$+7.08606\ 10^{-4}\ X^{12} + 0.00475705\ X^{11} - 0.0109665\ X^{10} -0.00464587\ X^{9} + 0.00470451\ X^{8} + 0.00314446\ X^{7} +0.0357651\ X^{6} + 0.0125011\ X^{5} - 0.0436851\ X^{4} -0.0539187\ X^{3} - 0.366152\ X^{2} + 0.458562\ X +0.929631$$

The centers of gravity of the sharpening members are below the sharpening edges 26 and 28, and they are closer than the pivots to the references plane RP. Thus, the center of gravity of the left sharpening member 2 is inboard of the pivot 6 so it will produce clockwise pivotal movement, and the center of gravity CG of the right sharpening member 4 is positioned inboard of its respective pivot so it will produce counterclockwise pivotal movement of the right sharpening member 4.

The force exerted by the sharpening edges 26, 28 on a blade in the slot 36 will increase as the slot vertex 38 moves down. A small part of this increase occurs because the outward rotation of a sharpening member increases the lateral distance between the pivot and the center of gravity of the sharpening member, thus increasing the torque which rotates the sharpening member. The increased force is primarily due to the fact that the distance from the pivot axis to the slot vertex is decreasing, thus shortening the length of the lever arm from the pivot to the slot vertex.

Figure 4:
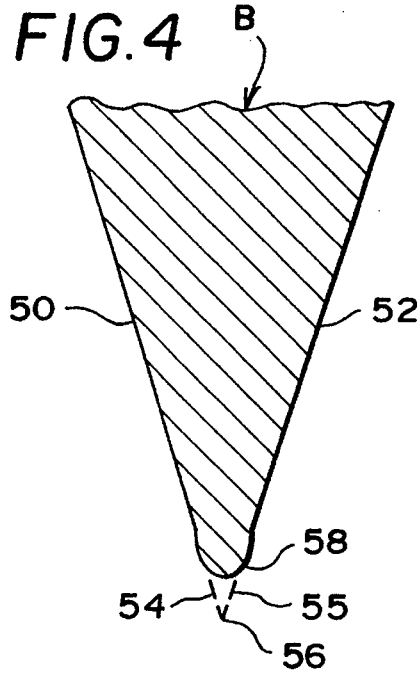
FIG. 4 is a microscopic diagram showing the geometric characteristics of the cutting edge of a cutting blade.

A microscopic diagram of a cutting blade B in the vicinity of its cutting edge as shown in FIG. 4. The cutting blade has two converging surfaces 50 and 52, the geometric extensions 54 and 55 of which intersect at an ideal cutting edge vertex 56. In a new knife, the metal may extend to the ideal cutting edge vertex but, in use, the blade becomes blunted so that its lower edge is spaced from the ideal cutting edge vertex and some of the metal of the blade has been displaced laterally to form a microscopic arcuate profile portion 58. The present invention reshapes this arcuate profile portion so that the blade material will be restored substantially to its ideal configuration.

At all positions of the sharpening members 2 and 4, except for their outermost positions where the slot vertex is at its lowest position 42, the sharpening forces exerted by the sharpening edges against the blade are precisely controlled due to the geometry and mounting of the sharpening members.

When a low downward force is exerted by a blade on the sharpening edges 26 and 28, the slot vertex 38 is relatively high, the sharpening forces are relatively low, and the sharpening edges 26 and 28 contact the blade closer to the ideal cutting edge vertex 56 because they are nearly linear in their upper regions. By increasing the downward force on the blade, the slot vertex moves down, the sharpening forces are increased, and the sharpening edges 26, 28 will contact the cutting blade farther from the ideal vertex 56 because their curvatures are greater in this region.

The geometry of the sharpening members 2 and 4, including their counterweight portions 30 and 31, and the locations of the pivots 6 and 8 produce the forces which the sharpening members exert on a cutting blade. As explained above, these forces increase in response to downward movement of the slot vertex; and, they are smaller when the sharpening edges contact the cutting blade nearer the ideal cutting edge vertex than when the sharpening edges contact the cutting blade farther from the ideal cutting edge vertex.

The device is bidirectional in the sense that an operator can face the device from the orientation shown in FIG. 1 or from the opposite direction. When sharpening a conventional knife blade, the blade is positioned where its vertical surface will ride along the guide surface 16. The blade is moved downwardly and drawn toward the operator with several strokes in order to sharpen it. The initial strokes can be made while using greater downward forces which drive the slot vertex near or to its lowest position. Thereafter, one or two lighter strokes are desirable to complete the sharpening process.

In some cutting blades, the cutting edge angle is asymmetrical to the cross section. In such an instance, the cutting blade is guided so that the bisector of its edge angle will lie in the reference plane. When the device of the invention is used to sharpen circular blades with circumferential cutting edges or cylindrical blades with cutting edges at their axial ends, the cutting edges are placed in the reference plane and the circular or cylindrical blades are rotated about their own axes.

Although only one embodiment of the invention has been shown, it will be recognized that it may take many different forms. Accordingly, it is emphasized that the invention is not limited to the disclosed embodiment but is encompassing of many variations thereof and modifications thereto which fall within the scope and spirit of the following claims.

I claim:

1. A sharpener for sharpening a cutting blade comprising, a left sharpening member pivotally supported on a left pivot which is spaced to the left of a reference plane, said left sharpening member having a left sharpening portion located above the left pivot and a left counterweight portion located below the left pivot, said left sharpening member having a center of gravity positioned to provide clockwise pivotal movement of said left sharpening member, said left sharpening portion having a left sharpening edge which faces rightward and intersects said reference plane to contact and sharpen a cutting blade located in said reference plane, a right sharpening member pivotally supported on a right pivot which is spaced to the right of the reference plane, said right sharpening member having a right sharpening portion located above the right pivot and a right counterweight portion located below the right pivot, said right sharpening member having a center of gravity positioned to provide counterclockwise pivotal movement of said right sharpening member, said right sharpening portion having a right sharpening edge which faces leftward and intersects said reference plane to contact and sharpen a cutting blade located in said reference plane.

2. A sharpener according to claim 1 wherein each of said sharpening edges has a curvature which increases progressively from upper regions of the sharpening edge to lower regions of the sharpening edge.

3. A sharpener according to claim 1 wherein the curvatures of said sharpening edges are such that, throughout their range of movement, they intersect the reference plane at a substantially constant angle.

4. A sharpener according to claim 1 wherein the sharpening members are formed of a material selected from the group consisting of zirconia and alumina.

5. A sharpener according to claim 1 having stop means for limiting the clockwise movement of said left sharpening member, and stop means for limiting the counterclockwise movement of said right sharpening member.

6. A sharpener according to claim 5, having a left pivot member which supports said left sharpening member, a right pivot member which supports said right sharpening member, said stop means for limiting the counterclockwise movement of the right sharpening member including said left pivot member, said stop means for limiting the clockwise movement of the left sharpening member including said right pivot member.

7. A sharpener according to claim 6, wherein the left pivot member supports an abutment which stops the clockwise movement of the right sharpening member, and the right pivot member supports an abutment which stops the counterclockwise movement of the left sharpening member.

8. A sharpener according to claim 1 including a blade guide which has a guide surface located substantially in said reference plane.

9. A sharpener for sharpening a cutting blade which has two converging surfaces, the geometric extensions of which in cross-section intersect at an ideal cutting edge vertex, comprising, two pivoted sharpening members with sharpening edges which form opposite sides of a V-shaped slot for receiving a cutting blade which has a cutting edge, said V-shaped slot having a slot vertex, said sharpening members being supported for movement about fixed pivots in directions which result in downward movement of the slot vertex, force producing means for producing forces which urge said sharpening members toward each other, said force producing means producing forces on the cutting blade which increase in response to downward movement of the slot vertex, each of said sharpening edges having a convex curvature which faces said slot, said convex curvatures increasing progressively from upper regions of the sharpening edges to lower regions of the sharpening edges, each sharpening member including a sharpening portion located above the respective pivot, and a counterweight portion located below the respective pivot.

10. A sharpener according to claim 9 wherein there is a reference plane which bisects said V-shaped slot, and the curvatures of said sharpening edges are such that, throughout their range of movement, they intersect the reference plane at a substantially constant angle.

11. A sharpener according to claim 9 wherein the sharpening members are formed of a material selected from the group consisting of zirconia and alumina.

12. A sharpener according to claim 9 having stop means for limiting the pivotal movement of said sharpening members.

13. A sharpener according to claim 9 having a frame, said fixed pivots on the frame for supporting the sharpening members, and an abutment mounted on each pivot to limit the pivotal movement of the other sharpening member.

14. A knife sharpener for sharpening a cutting blade having two converging surfaces, the geometric extensions of which in cross-section intersect at an ideal cutting edge vertex, comprising, two pivoted sharpening members with sharpening edges which form opposite sides of a V-shaped slot for receiving a cutting blade which has a cutting edge, said V-shaped slot having a slot vertex, said sharpening members having curvatures which vary progressively along their lengths and being moveable to position where they contact the cutting blade at different distances from the ideal cutting edge vertex, force producing means producing forces on the cutting blade which are smaller when the sharpening edges contact the cutting blade nearer the ideal cutting edge vertex than when the sharpening edges contact the cutting blade farther from the ideal cutting edge vertex.

15. A sharpener for sharpening a cutting blade which has two converging surfaces, the geometric extensions of which in cross-section intersect at an ideal cutting edge vertex, comprising, two pivoted sharpening members with sharpening edges which form opposite sides of a V-shaped slot for receiving a cutting blade which has a cutting edge, said V-shaped slot having a slot vertex located in a reference plane, fixed pivots for supporting said sharpening members, said fixed pivots being lower than said sharpening edges, each of said sharpening members having a center of gravity which is lower than its sharpening edge and is closer than its pivot to the reference plane so that the sharpening members are gravitationally rotated in directions which urge their sharpening edges above said slot vertex toward said reference plane, and gravitationally produced forces exerted by the sharpening edges on the blade increase in response to downward movement of the cutting blade and slot vertex.

16. A sharpener according to claim 15 wherein each of said sharpening edges has a convex curvature which faces said slot, said convex curvatures increasing progressively from upper regions of the sharpening edges to lower regions of the sharpening edges.

17. A sharpener according to claim 16 wherein the curvatures of said sharpening edges are such that, throughout their range of movement, they intersect the reference plane at a substantially constant angle.

18. A sharpener according to claim 15 wherein the sharpening members are formed of a material selected from the group consisting of zirconia and alumina.

19. A sharpener according to claim 15 having stop means for limiting the pivotal movement of said sharpening members.

20. A sharpener according to claim 15 having a frame, said fixed pivots on the frame for supporting the sharpening members, and an abutment mounted on each pivot to limit the pivotal movement of the other sharpening member.

21. A method of sharpening a cutting blade which has two converging surfaces, the geometric extensions of which in cross-section intersect at an ideal cutting edge vertex, said method being performed with two pivoted sharpening members with sharpening edges which form opposite sides of a V-shaped slot for receiving a cutting blade which has a cutting edge, said V-shaped slot having a slot vertex located in a reference plane, said method including the steps of:

supporting said sharpening members for movement about fixed pivots which are lower than said sharpening edges, each of said sharpening members having a center of gravity which is lower than its sharpening edge and is closer than its pivot to the reference plane so that the sharpening members are gravitationally rotated in directions which urge their sharpening edges above said slot vertex toward said reference plane, and holding and moving the cutting edge of a cutting blade in said slot vertex at a position where the slot vertex is higher than said pivots so that gravitationally produced forces exerted by the sharpening edges on the blade increase in response to downward movement of the cutting blade and slot vertex.

22. A method according to claim 21 including the step of moving said cutting blade and slot vertex downwardly while maintaining said sharpening edges at said slot vertex at substantially constant angles to said reference plane.

23. A method according to claim 21, including the step of limiting the movement of said sharpening members to stop the downward movement of said blade and slot vertex.

* * * * *